US011117273B2

(12) United States Patent
Arvinte

(10) Patent No.: US 11,117,273 B2
(45) Date of Patent: Sep. 14, 2021

(54) SELF-RETRACTING KNIFE WITH A PLURALITY OF EXTENDED CUTTING POSITIONS

(71) Applicant: HYDE TOOLS, INC., Southbridge, MA (US)

(72) Inventor: Romeo Arvinte, Laval (CA)

(73) Assignee: HYDE TOOLS, Inc., Southbridge, MA (US)

( * ) Notice: Subject to any disclaimer, the term of this patent is extended or adjusted under 35 U.S.C. 154(b) by 158 days.

(21) Appl. No.: 16/689,299

(22) Filed: Nov. 20, 2019

(65) Prior Publication Data

US 2020/0198158 A1 Jun. 25, 2020

Related U.S. Application Data

(63) Continuation of application No. PCT/US2018/034921, filed on May 29, 2018.

(60) Provisional application No. 62/511,939, filed on May 26, 2017.

(51) Int. Cl.
*B26B 5/00* (2006.01)
*B26B 1/08* (2006.01)

(52) U.S. Cl.
CPC ..... *B26B 5/003* (2013.01)

(58) Field of Classification Search
CPC ..... B26B 5/003; B26B 5/001; B26B 1/08; B26B 5/006
See application file for complete search history.

(56) References Cited

U.S. PATENT DOCUMENTS

| | | | | |
|---|---|---|---|---|
| 4,320,576 | A * | 3/1982 | Beermann | B26B 5/003 30/162 |
| 5,012,581 | A | 5/1991 | Fletcher et al. | |
| 5,813,121 | A | 9/1998 | Gringer | |
| 6,438,849 | B1 | 4/2002 | Wonderley | |
| 6,418,624 | B1 | 7/2002 | Huang | |
| 2009/0235533 | A1 | 9/2009 | Huang | |
| 2009/0277016 | A1 | 11/2009 | Wu | |
| 2013/0239415 | A1 * | 9/2013 | Wagner | B26B 1/08 30/162 |
| 2015/0013171 | A1 * | 1/2015 | Wu | B26B 5/003 30/162 |

* cited by examiner

*Primary Examiner* — Stephen Choi
(74) *Attorney, Agent, or Firm* — Louis J. Franco; Law Office of Louis J. Franco

(57) ABSTRACT

A knife includes a handle body defining an interior blade-slide cavity housing a blade slide carrying a blade with a cutting edge. The blade slide is reciprocated within the blade-slide cavity between a blade-storage position in which the cutting edge is housed within the handle body and at least two blade-protruding positions in which the cutting edge protrudes to the exterior of the handle body, through a forward-end opening, to disparate extents. Blade-slide reciprocation is facilitated by a blade-slide actuator that includes a button reciprocable along an actuator slot defined through the handle body. A handle-body undulated surface defined along the handle body in the vicinity of the actuator slot is configured for selective mechanical interference with a button undulated surface in order to define the at least two blade-protruding positions. A blade-protruding position is temporarily maintained through a user's depression of the button to maintain the selective interference.

10 Claims, 7 Drawing Sheets

SELF-RETRACTING KNIFE WITH A PLURALITY OF EXTENDED CUTTING POSITIONS

CROSS-REFERENCE TO RELATED APPLICATIONS/PRIORITY CLAIMS

The present application is a continuation application of International Application Serial No. PCT/US2018/034921 filed May 29, 2018 pursuant to the Patent Cooperation Treaty, and under the title "SELF-RETRACTING KNIFE WITH A PLURALITY OF EXTENDED CUTTING POSITIONS." Application PCT/US2018/034921 claimed priority benefits in U.S. Provisional Application No. 62/511,939 filed May 26, 2017 under the title "SELF-RETRACTING KNIFE WITH A PLURALITY OF EXTENDED CUTTING POSITIONS."

The present application claims the benefit of the filing date of Provisional Application Ser. No. 62/511,939, as well as the filing date of PCT Application No. PCT/US2018/034921, based on the priority chain outlined above. Moreover, the entireties of the disclosures, including the drawings, of both previous applications in the aforesaid priority chain are incorporated herein by reference as if set forth fully in the present application.

BACKGROUND

Utility knives of various configurations and functionalities are ubiquitous and familiar to professionals, homeowners, and casual users alike. In some manifestations, such utility knives are referred to as "box cutters," although their applications are far broader than that designation suggests.

Generically, a utility knife includes a housing that serves as a handle for gripping by a user's hand. The housing defines an interior channel or cavity that accommodates for linear reciprocation along a longitudinal handle axis a blade slide that carries a blade with a cutting edge. Reciprocation of the blade slide is facilitated by a button—or "thumb button"—accessible to a user's finger (e.g., thumb) from the exterior of the housing. Displacement of the button along a track or slot linearly displaces the blade slide between retracted and extended positions corresponding to positions in which the cutting edge of a blade carried by the blade slide is, respectively, stored within the housing and protruding from the housing through a forward-end blade opening in the housing for cutting of material.

Also typical of an existing utility knife is that the button, which is normally biased outwardly toward the housing exterior, is depressed inwardly toward the housing to disengage it from one of the predefined positions, corresponding to a retracted or extended position of the blade slide, so that it can be linearly displaced to move the blade slide into another predefined position. Various utility knives include a plurality of button positions corresponding to predefined extended positions in which the cutting edge of a blade carried by the blade slide extends out of the housing by varying degrees or extents. Such predefined positions are advantageous in facilitating disparate cutting depths. More specifically, it is generally wise and advantageous to have the blade protrude from the housing only as much as required to cut through a material of predetermined thickness, and predefined positions facilitate the same.

Another type of utility knife is self-retracting. One example of a self-retracting utility knife is described and claimed in U.S. Pat. No. 5,012,581 assigned to Hyde Manufacturing Company, an entity historically related to present Applicant, Hyde Tools, Inc. In a self-retracting utility knife, the blade slide is normally biased toward a retracted position. Moreover, the thumb button is not normally biased toward the exterior of the housing for selective engagement into predefined button positions, as in the previous example described above. Instead, when a user is cutting a material, such as cardboard, for example, (s)he slides the thumb button forward to extend the blade from the housing. Next, (s)he penetrates with the blade the material being cut and releases the thumb button. Friction between the blade and the material to be cut retains the blade in an extended position in opposition to the biasing force that normally biases the blade into a retracted position. With the blade "pinched" between the material to be cut on either side, the user runs the blade through the material to make the desired cut. As the blade emerges from the material at the end of the cut, the blade is immediately retracted into the housing by the biasing force favoring blade retraction, so long as the user does not prevent blade retraction by keeping his or her finger on the thumb button during the cut. In any event, whether the user releases the thumb button before or after the cut is made, the user's release of the thumb button results in blade retraction.

Each of the main types of utility knife briefly described above provides its own advantageous. However, the advantages resulting from these disparate configurations have been mutually exclusive. That is, a utility knife has offered either a plurality of predefined blade-extension positions or self-retraction of the blade after a cut is made.

Accordingly, a need exists for a single knife that provides both a plurality of blade-protruding positions and self-retraction.

SUMMARY

In one illustrative embodiment, a cutting knife is configured for use with a removable cutting blade having a cutting edge. The knife includes a handle body that extends longitudinally along a handle-body axis between a handle rear end and handle forward end including a forward-end opening. The handle body serves as a housing and defines an internal blade-slide cavity that is in communication with, and extends rearwardly from, the forward-end opening. An actuator slot defined through the handle body extends longitudinally between opposed slot first and second ends, the slot second end being more proximate the forward-end opening than is the slot first end.

A blade slide is housed at least partially within the blade-slide cavity. The blade slide is configured for (i) removably retaining a cutting blade and (ii) linear reciprocation with the blade-slide cavity between a rearwardmost blade-storage position and a forwardmost blade-protruding position. In the forwardmost blade-protruding position, a cutting blade carried by the blade slide maximally protrudes through the forward-end opening. Conversely, in the blade-storage position, the cutting edge of a blade carried by the blade slide is with withdrawn rearward of the forward-end opening and housed within the blade-slide cavity.

A user selectively reciprocates the blade slide relative to the handle body through a blade-slide actuator. The blade-slide actuator includes a thumb button and a flexible member (hereinafter, "flexible finger") through which the thumb button is connected to the blade slide. The thumb button includes a button inner surface facing the blade slide to the interior of the blade-slide cavity and a button outer surface opposite the button inner surface that faces the exterior of the handle body. The button outer surface is accessible from the exterior of the handle body through the actuator slot for selective engagement by a user's thumb in order to facilitate linear reciprocation of the blade-slide actuator between the slot first and second ends. Reciprocation of the blade-slide actuator toward the opposed slot first and second ends longitudinally displaces the blade slide toward, respectively, the rearwardmost blade-storage and forwardmost blade-protruding positions.

Defined along the actuator slot of the handle body is at least one handle-body undulated surface. Additionally, the button inner surface has defined there-along a button undulated surface. The handle-body and button undulated surfaces are configured and aligned to define a plurality of at least two blade-protruding positions. As the thumb button is displaced forwardly away from the slot first end toward the slot second end, the button undulated surface begins to "ride" over the handle-body undulated surface. By the selective interfering engagement of the button undulated surface with the handle-body undulated surface, disparate blade-protruding positions can be selected. Each blade-protruding position is temporarily maintained by a user's inwardly depressing toward the blade slide the thumb button such that the handle-body and button undulated surfaces are maintained in mutual mechanical interference.

In an alternative embodiment, the cutting knife is configured to be self-retracting. In each of various such versions, the blade slide is normally mechanically biased toward the rearwardmost blade-storage position such that, in the absence of an external force applied to linearly displace the blade slide forward of the rearwardmost blade-storage position, a cutting blade carried by the blade slide is retracted within the blade-slide cavity. Moreover, in some versions in which there is provided a mechanical bias of the blade slide toward a blade-storage position, the flexible finger by which the thumb button is attached to the blade slide is resilient, and provides a slight mechanical bias of the thumb button "inwardly" toward the blade slide. Accordingly, when the button and handle-body undulated surfaces are adjacent one another (e.g., longitudinally aligned), there is a slight mechanical bias of the button undulated surface toward the handle-body undulated surface.

In order to ensure that the mechanical bias drawing the handle-body and button undulated surfaces toward one another does not interfere with self-retraction of the blade slide, the relevant components are configured such that the bias resulting in self-retraction overcomes the forces biasing the thumb button toward the handle-body undulated surface. It is only by application of an external force (e.g., a user's depressing the thumb button) that the biasing force responsible for self-retraction is overcome to maintain a blade-protruding position. Accordingly, when a user releases the thumb button after making a cut, for example, the blade and blade slide are withdrawn into the handle body.

In each of various self-retracting configurations, the blade slide is normally mechanically biased by a biasing member with a forward end attached to the blade slide and a rearward end anchored to the handle body one of (i) directly and (ii) through an intermediate mechanical element. In one such version, the cutting knife further includes an on-board tape splitter that functions as an intermediate element by which the rearward end of the biasing member is anchored to the handle body. More specifically, the handle rear end has defined therein a rear-end slot. The tape splitter includes a tape-splitting edge and a splitter-retaining edge opposite the tape-splitting edge. The tape splitter is retained within the rear-end slot such that the tape-splitting edge protrudes from the handle rear end and the splitter-retaining edge extends into the handle body through the rear-end slot where it retains the rearward end of the biasing member. By the mutual connection of the blade slide and tape splitter through the biasing member, the blade slide and tape splitter are biased toward one another, with the blade slide being biased rearwardly and the tape splitter being biased forwardly relative to the handle body. Moreover, by this arrangement, the tape splitter and blade slide retain one another within the handle body.

Representative embodiments are more completely described and depicted in the following detailed description and the accompanying drawings.

DETAILED DESCRIPTION

The following description of variously embodied cutting knives is demonstrative in nature and is not intended to limit the invention or its application of uses. Accordingly, the various implementations, aspects, versions and embodiments described in the summary and detailed description are in the nature of non-limiting examples falling within the scope of the appended claims and do not serve to restrict the maximum scope of the claims.

Figure 1:
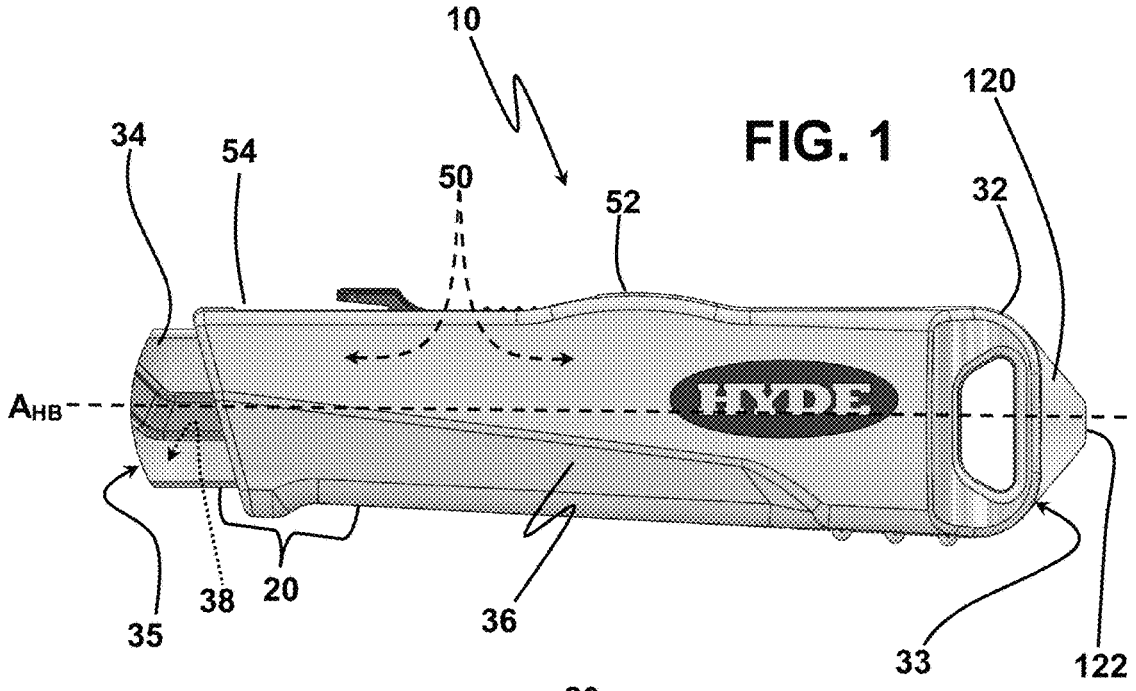
FIG. 1 is a left side view of a "top button" self-retracting knife including a two-piece handle body housing a blade slide.
Figure 2:
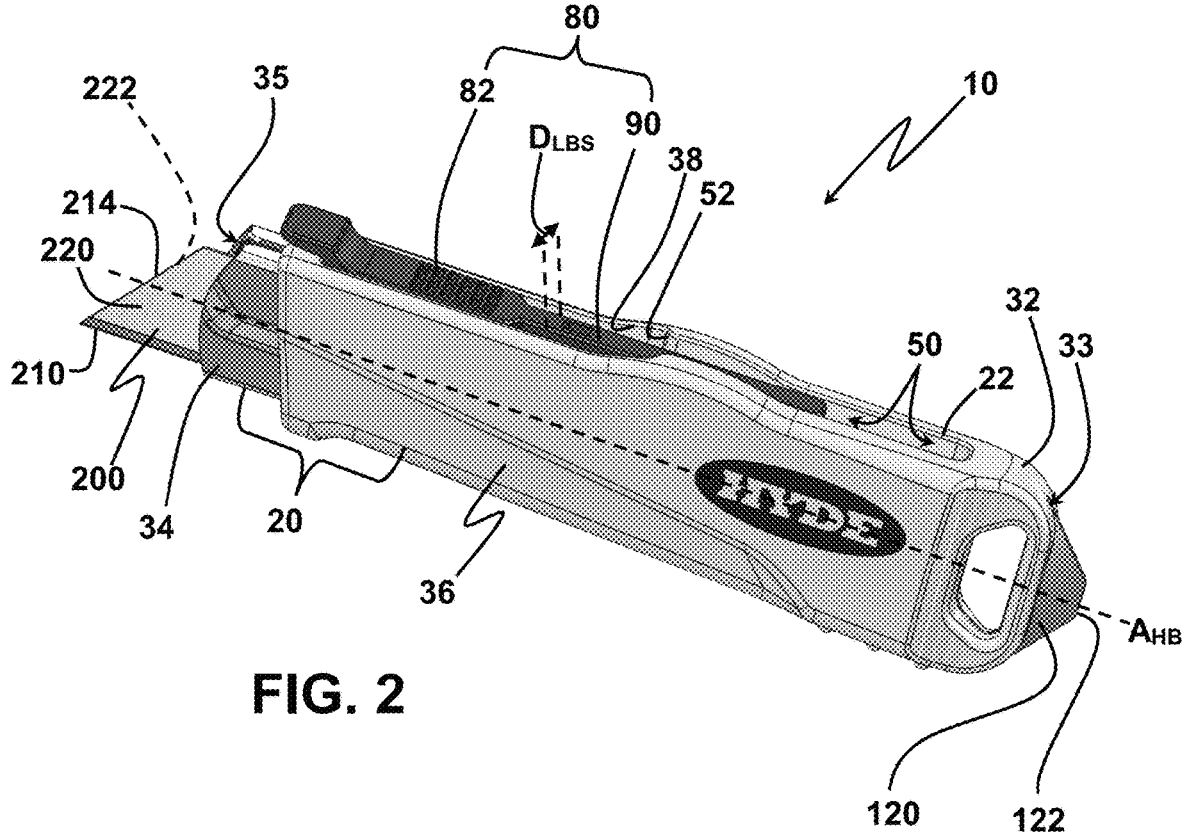
FIG. 2 is a left side and top view of the self-retracting knife of FIG. 1.
Figure 3:
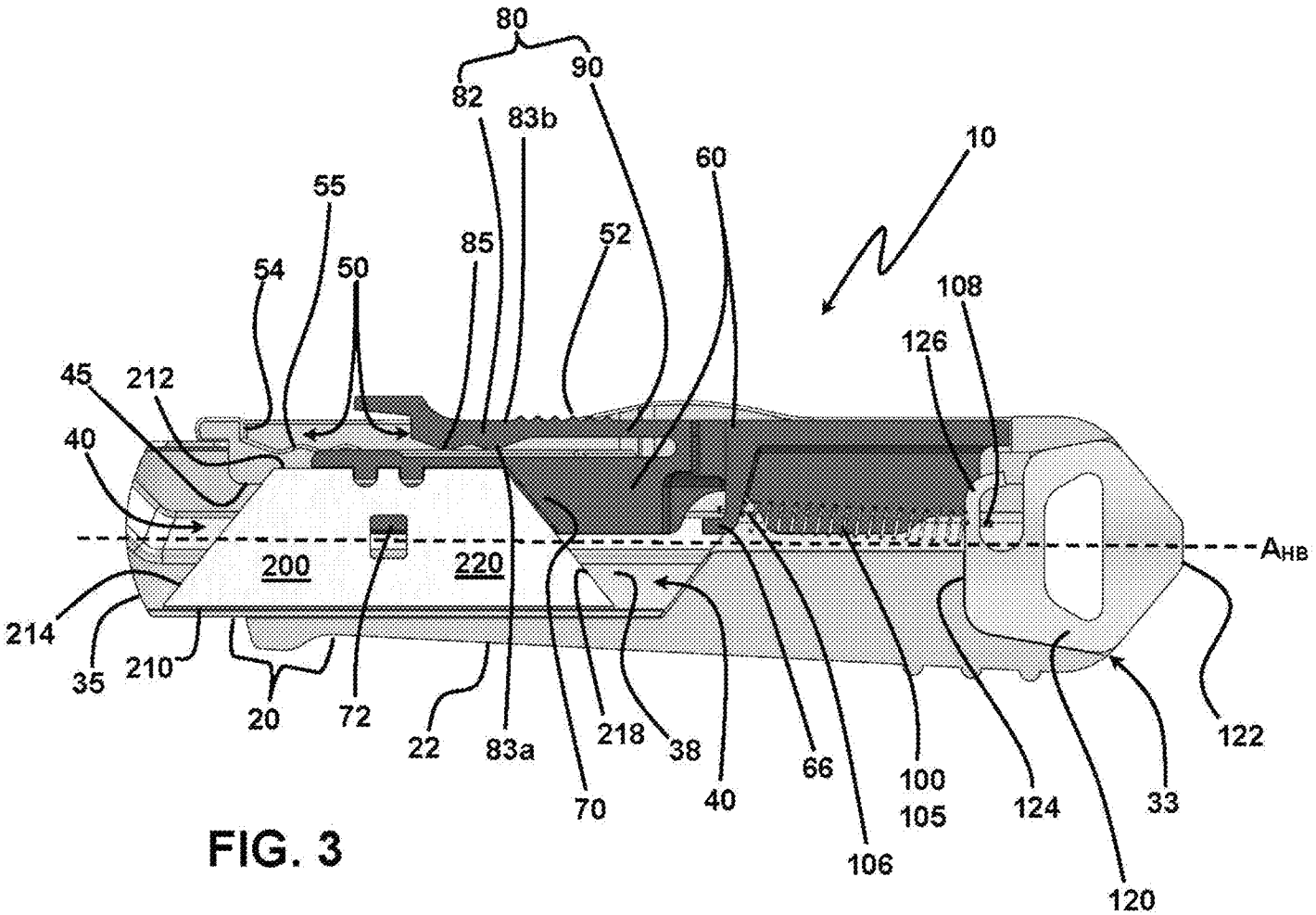
FIG. 3 is a left side cross-sectional view of the self-retracting knife of FIGS. 1 and 2.

With initial reference to the exterior views of FIGS. 1 and 2, and the cross-sectional view of FIG. 3, there is described an illustrative self-retracting knife 10 configured for use with a removable cutting blade 200. The cutting blade 200 has a lower cutting edge 210, an upper edge 212 opposite the cutting edge 210, opposed first and second side edges 214 and 218 extending between the cutting and upper edges 210 and 212, and opposed first and second flat surfaces 220 and 222 bounded by the edges 210, 212, 214, and 218. In the particular embodiments described and depicted throughout the specification and drawings, the cutting blade 200 is trapezoidal. However, it is to be understood that, in the absence of explicit limiting language to the contrary, embodiments of a self-retracting knife 10 configured for use with alternatively-shaped cutting blades 200 (e.g., curved blades or rectangular blades) are within the scope and contemplation of the invention as defined in the appended claims.

Referring still to FIGS. 1 through 3, the self-retracting knife 10 has a handle body 20 and a blade slide 60 that is housed within the handle body 20 for linear reciprocation relative to thereto. The handle body 20 comprises at least one handle-body wall 22 and extends longitudinally along a handle-body axis $A_{HB}$ between a handle rear end 32 and a handle forward end 34 including a forward-end opening 35. Additionally, the handle body 20 includes a handle-body outer surface 36 and a handle-body inner surface 38 defining an internal blade-slide cavity 40 that extends rearwardly from the forward-end opening 35 toward the handle rear end 32 and is configured to selectively receive and house a cutting blade 200.

Defined through the handle-body wall 22 is an elongated actuator slot 50. The actuator slot 50 extends longitudinally between a slot first end 52 and a slot second end 54 that is more proximate the forward-end opening 35 than is the slot first end 52. The purpose of the actuator slot 50 is subsequently explained in detail.

Figure 4:
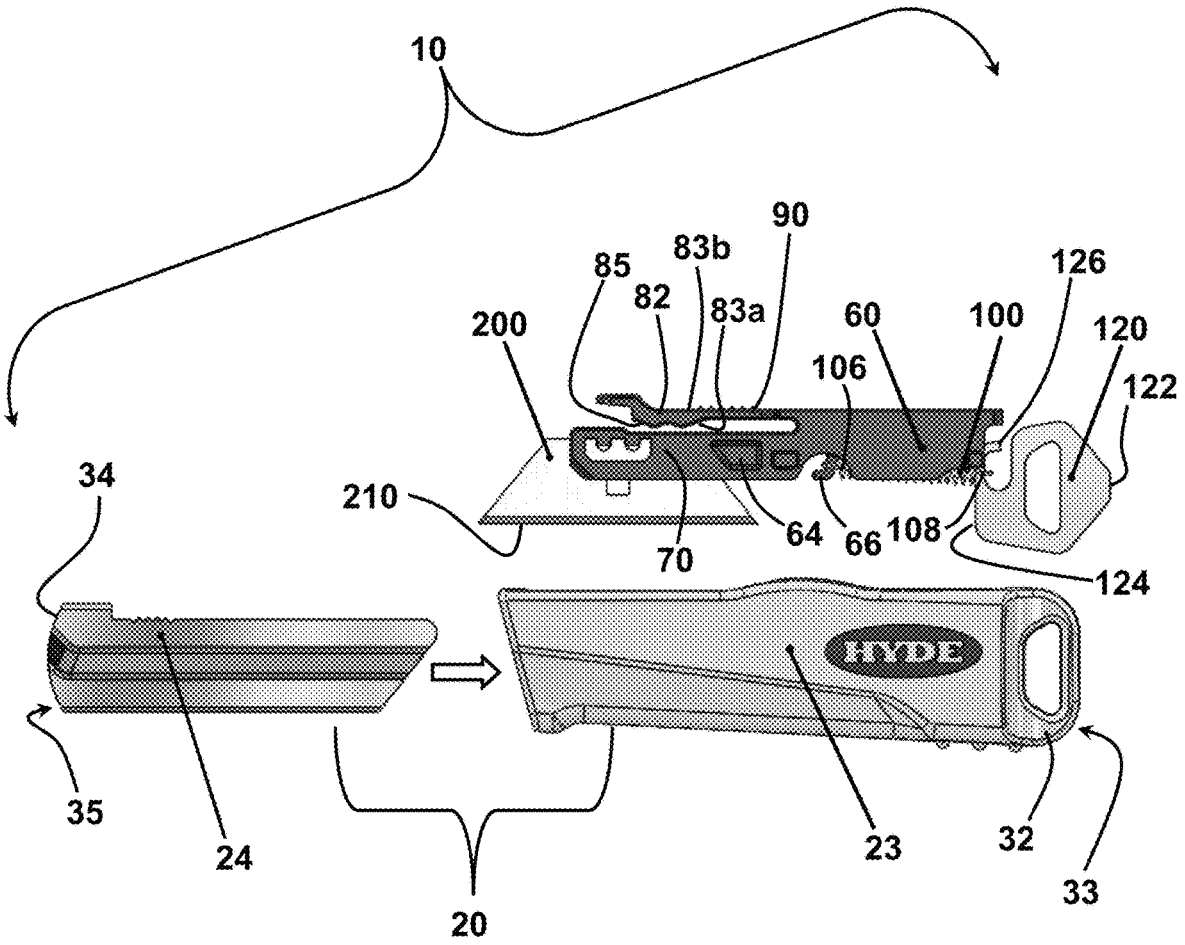
FIG. 4 is an exploded view of the self-retracting knife shown in FIGS. 1-3.

With continued reference to FIG. 3, and additional reference to the exploded view of FIG. 4, the blade slide 60 includes at least one blade platform 70 with a blade-engaging surface 72 configured for selectively engaging and supporting one of the flat surfaces 220 and 222 of a cutting blade 200 such that, when the blade slide 60 is retained by the handle body 20, the cutting edge 210 of the cutting blade 200, when properly positioned relative to the blade platform 70, extends principally parallel to the handle-body axis $A_{HB}$ shown in FIGS. 1-3. Also discernable from the exploded view of FIG. 4 is that the illustrative embodiment presently under consideration is that the handle body 20 includes an outer grip portion 23 and an inner blade-guide portion 24, the latter of which is housed within the former, inserted during fabrication, for example. However, it is to be understood that the handle body 20 need not be configured as two main components such as these, and that this is illustrative of a single embodiment within the broader scope of the invention as claimed. More specifically, manufacturing processes of the embodiment depicted indicated a preference for fabrication of a two-piece handle body 20.

As indicated most clearly in the cross-sectional view of FIG. 3, the blade slide 60 is at least partially housed within the blade-slide cavity 40 for longitudinal reciprocation, relative to the handle body 20. More specifically, the blade slide 60 can be reciprocally displaced—linearly along the handle-body axis $A_{HB}$, for instance—between a rearwardmost blade-storage position in which the cutting edge 210 of a cutting blade 200 carried by the blade platform 70 is housed within the blade-slide cavity and does not extend beyond the forward-end opening 35 and a forwardmost blade-protruding position in which a cutting blade 200 carried by the blade slide 200 maximally protrudes through the forward-end opening 35 to the exterior of the handle body 20. Reciprocation of the blade slide 60 within the handle body 20 is facilitated by a blade-slide actuator 80 including a thumb button 82 and a flexible finger 90 through which the thumb button 82 is connected to the blade slide 60.

Figure 5A:
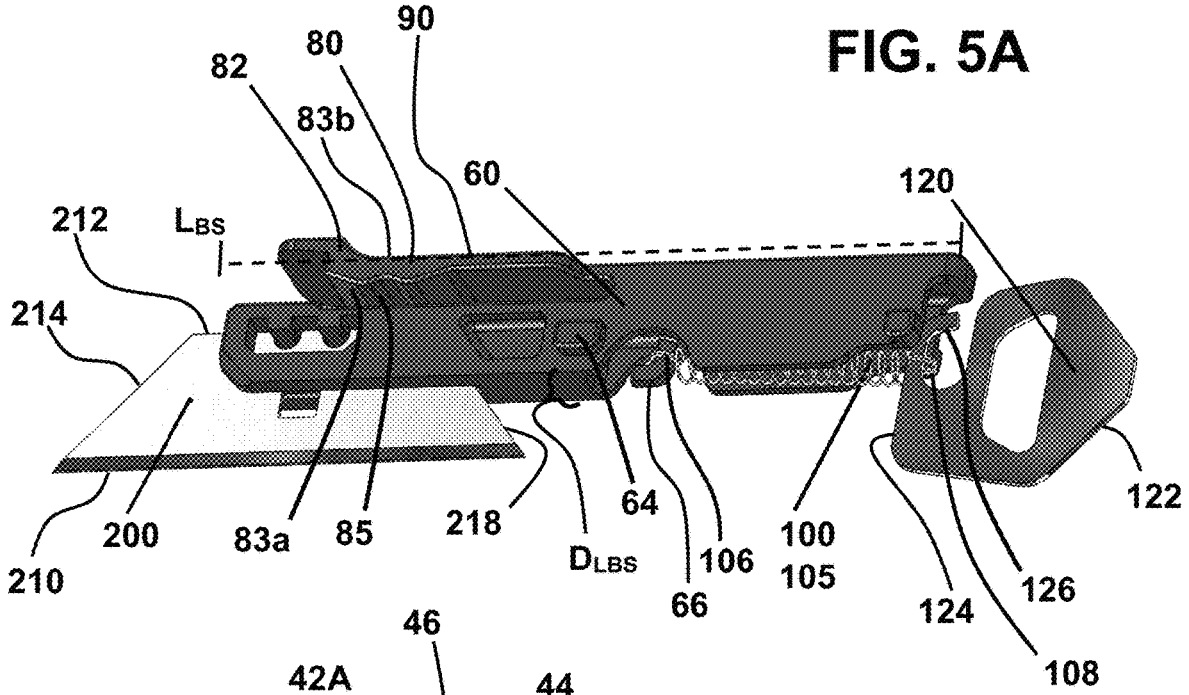
FIG. 5A is a left side bottom view of the blade slide of the self-retracting knife shown in FIGS. 1-4.
Figure 5B:
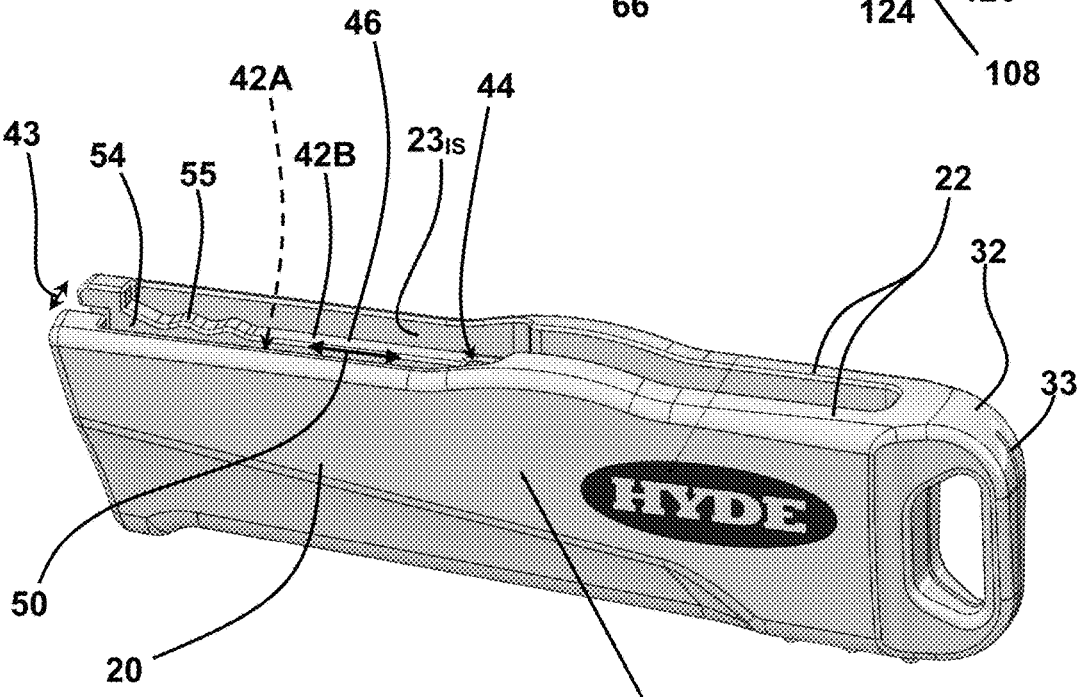
FIG. 5B is a left side, top and rear end view of the grip portion of the two-piece handle body of the self-retracting knife depicted in FIGS. 1-4.

As shown perhaps most clearly in the cross-sectional view of FIG. 3 and exploded views of FIGS. 4, 5A, and 5B, the thumb button 82 includes a button inner surface 83*a* facing the blade slide 60 to the interior of the blade-slide cavity 40 and a button outer surface 83*b* that is opposite the button inner surface 83*a* and faces the exterior of the handle body 20. The button outer surface 83*b* is accessible from the exterior of the handle body 20 through the actuator slot 50 for selective engagement, and linear reciprocation along the handle body 20 between the slot first and second ends 52 and 54, by a user's thumb (not shown). Reciprocal displacement of the thumb button 82 of the blade-slide actuator 80 toward, alternatively, the slot first and second ends 52 and 54 displaces the blade slide 60 toward, respectively, the rearwardmost blade-storage position and the forwardmost blade-protruding position. Selective cooperative engagement between the thumb button 82 and handle body 20 defines a plurality of at least two blade-protruding positions in a manner explained in detail below.

With continued reference to FIG. 3, the handle body 20 has defined along the actuator slot 50 a handle-body undulated surface 55, while the button inner surface 83*a* has defined there-along a button undulated surface 85 aligned and configured for selective interfering engagement with the handle-body undulated surface 55. As the thumb button 82 is displaced forwardly away from the slot first end 52 toward the slot second end 54, the button undulated surface 85 begins to "ride" over the handle-body undulated surface 55. In each of various embodiments, the flexible finger 90 by which the thumb button 82 is attached to the blade slide 60 is resilient, and provides a slight mechanical bias of the thumb button 82 "inwardly" toward the blade slide 60 and, thereby, a slight mechanical bias of the button undulated surface 85 toward the handle-body undulated surface 55. In order to facilitate the undulated surfaces 55 and 85 riding over and passing by one another as desired, each of them is, in various versions, including the versions depicted, substantially sinusoidal in profile. By "substantially sinusoidal" is meant that each of the button and handle-body undulated surfaces 85 and 55 is likely to conjure in the minds of observers a sin wave, and not that each, of necessity, is literally characterizable as a sin wave in strict mathematical terms.

As the button undulated surface 85 is linearly reciprocated over the handle-body undulated surface 55, a user will feel the thumb button 82 move slightly toward and away from the blade side 60 between, respectively and relatively, "depressed" and "raised" button attitudes. Each of the "depressed" attitudes corresponds to an "interference fit" between the button and handle-body undulated surfaces 85 and 55, as well as a corresponding blade-protruding position of the blade slide 60. When a user detects, either visually or by feel, a desired degree of blade protrusion for a particular cutting task, he or she can temporarily maintain the corresponding blade-protruding position by increasing the inward force (e.g., press down harder) on the button outer surface 83*b* in order to prevent linear displacement of the blade slide 60 relative to the handle body 20 while cutting by virtue of mutual mechanical inference between the button and handle-body undulated surfaces 85 and 55.

In each of various versions, the blade slide 60 is normally mechanically biased toward the rearwardmost blade-storage position. Accordingly, in the absence of an external force applied to linearly displace the blade slide 60 forward of the rearwardmost blade-storage position, a cutting blade 200 carried by the blade slide 60 is retracted within the blade-slide cavity 40. As shown in FIG. 3, for example, the rearward mechanical bias of the blade slide 60 is achieved by a biasing member 100 which, in the specific example shown, takes the form of a coil spring 105. The biasing member is attached at a forward end 106 to the blade slide 60, while a rearward end 108 thereof is anchored to the handle body 20, either directly or through an intermediate mechanical element.

An alternative version of a self-retracting knife 10 within the scope and contemplation of the invention includes an "on-board" implement for "splitting" tape, such as packaging tape. For instance, the illustrative self-retracting knife 10 of FIGS. 1-4 includes a rear-end slot 33 in the handle rear end 32. Slidably received and retained within the rear-end slot 33 is a tape splitter 120. In the present case, the tape splitter 120 is essentially a planar piece of material (e.g., metal or plastic) with tape-splitting edge 122 which, when the tape splitter 120 is seated within the rear-end slot 33, protrudes from the handle rear end 32.

The tape-splitting edge 122 need not be sharp like a cutting edge; as those familiar with packaging operations and packaging tape, for example, know, adhesive tape under tension can be "split" by relatively dull implements, such as a paper clip, a finger nail, or a key. Accordingly, even a dull tape-splitting edge 122 is sufficient to achieve the tape-splitting function while avoiding presentation of a sharp edge on which a person could cut himself or herself.

Opposite the tape-splitting edge 122 is a splitter-retaining edge 124 by which the tape splitter 120 is selectively retained within the rear-end slot 33. In the specific version of FIGS. 1-4, the splitter-retaining edge 124 defines a retention hook 126 configured for hooking, and selectively retaining, the looped rearward end 108 of the coil spring 105. With the forward end 106 of the coil spring 105 hooked by a retaining hook 66 depending from the blade slide 60, the tape splitter 120 is retained within the rear-end slot 33 by action of a forward bias exerted thereon by the biasing member 100 (i.e., coil spring 105 in this case). That is, by the connection of the blade slide 60 to the tape splitter 120 through the biasing member 100, the blade slide 60 and tape splitter 120 are biased toward one another; the blade slide 60 being biased rearwardly, while the tape splitter 120 is biased forwardly relative to the handle body 20.

As previously indicated, embodiments of a self-retracting knife 10 in accord with the invention are configured for use with removable blades 200 that can be changed (i.e., replaced) as required by wear or breakage. This warrants a general description of how blade changing is facilitated. As discussed in association with FIGS. 1-4, the thumb button 82 is connected to the blade slide 60 through a flexible finger 90. Also previously explained was that reciprocation of the thumb button 82 within the actuator slot 50 correspondingly reciprocates the blade slide 60 within the blade-slide cavity 40.

Delineating the blade-slide cavity 40 from the actuator slot 50 of the handle body 20 is a pair of mutually parallel first and second guide rails 42A and 42B extending longitudinally along the handle-body axis $A_{HB}$ and defining a rail gap 43 therebetween. These aspects are most clearly shown in FIG. 5B, which is a view of the outer grip portion 23 of the handle body 20 separate from the inner blade-guide portion 24 of the handle body 20, both of which portions 23 and 24 are shown mutually separated in FIG. 4. In this example, the guide rails 42A and 42B extend inwardly (laterally) toward one another from a grip-portion interior surface $\mathbf{23}_{IS}$. As shown in FIG. 5A, which is view of the blade slide 60 separated from the handle body 20, the blade slide 60 has a lateral dimension $D_{LBS}$ which, for most of the blade-slide length $L_{BS}$, permits its fitting between the guide rails 42A and 42B so that it can be lifted out through the actuator slot 50.

While the lateral dimension $D_{LBS}$ of the blade slide 60 and the rail gap 43 are relatively configured such that, when the blade slide 60 is in a proper longitudinal position relative to the handle body 20, the blade slide 60 can be lifted out of the handle body 20 from between the guide rails 42A and 42B, there are also elements for maintaining the blade slide 60 within the blade-slide cavity 40 for normal use. These blade-slide-retaining elements are described below with reference to FIGS. 4, 5A, and 5B.

Referring first to FIGS. 4 and 5A for their depictions of the blade slide 60, it can be seen that the blade slide 60 includes at least one laterally-protruding lug 64. An exemplary configuration includes a similar lug 64 on the side opposite the side of the blade slide 60 shown in FIGS. 4 and 5A. The guide rail 42B visible in FIG. 5 includes a rail notch 44. In a fabricated embodiment, there would be a rail notch 44 corresponding to each laterally-protruding lug 64. The discussion of the present embodiment will proceed on the assumption that there is a laterally-protruding lug 64 on either side of the blade slide 60, and a corresponding rail notch 44 along each of the two guide rails 42A and 42B.

In normal use, as the blade slide 60 reciprocates within the blade-slide cavity 40, each of the laterally-protruding lugs 64 slides along a rail bottom surface 45 (see FIG. 3) of whichever of the first and second guide rails 42A and 42B to which that laterally-protruding lug 64 corresponds. At the same time, the button inner surface 83*a* slides along rail top surfaces 46 of the first and second guide rails 42A and 42B. It can also be seen clearly in FIG. 5 that it is along each rail top surface 46 that a handle-body undulated surface 55 is defined. While only the second guide rail 42B, and the handle-body undulated surface 55 that it defines, are visible in FIG. 5, it will be readily appreciated that the side unseen, and including the obstructed first guide rail 42A, is essentially a mirror image of the visible side in this regard.

In the embodiment of FIGS. 1-5B, removal of the blade slide 60 from the handle body 20 through the actuator slot 50 requires mutual longitudinal alignment of each of the laterally-protruding lugs 64 of the blade slide 60 with its corresponding rail notch 44 defined along the first and second guide rails 42A and 42B. When proper longitudinal alignment is achieved, the laterally-protruding lugs 64 can pass through the rail notches 44, thereby permitting the lifting of the blade slide 60—by the thumb button 82—out of the handle body 20 through the actuator slot 50. The blade slide 60 need not be entirely removed, only enough to permit removal and/or replacement of a cutting blade 200. The blade slide 60 is reinstalled in the blade-slide cavity 40 by reversing the removal operation.

The embodiment of FIGS. 1-5B is regarded as having a "top button." That is, relative to the handle body 20, the thumb button 82 is deemed to reside along the "top" of the handle body 20. FIGS. 6-9 depict an embodiment in which the thumb button 82 is deemed to reside along a side of the handle body 20, and is thus referred to as a "side-button" configuration. In almost all material respects, the side-button embodiment includes elements corresponding directly to the elements depicted and explicitly referenced by numeric and alphanumeric reference characters in association with the top-button embodiment of FIGS. 1-5B. Accordingly, in describing the illustrative side-button configuration, elements corresponding to elements of the illustrative top-button configuration are referenced using the same numeric or alphanumeric reference characters. In addition to providing an alternative configuration, the views of FIGS. 6-9 also reveal components that were not directly visible in the views of FIGS. 1-5B, such as, for example, both the first and second guide rails 42A and 42B.

As previously indicated, the illustrative embodiment of FIGS. 6-9 is a configuration alternative to that shown in FIGS. 1-5B. In most key respects, the components and general functionality of the two versions are the same, similar or analogous. Consequently, much of the description of both components and function provided in connection with the version of FIGS. 1-5B applies with equal validity and efficacy to the version of FIGS. 6-9. Accordingly, the description of the version of FIGS. 6-9 is less exhaustive and detailed. In some instances, reference numbers are used in FIGS. 6-9 to refer to elements that are not expressly discussed in connection with the version of FIGS. 6-9. In such instances, the discussion provided in connection with the version of FIGS. 1-5B is relied upon to support the disclosure and, when and if applicable, separate claiming of the latter version.

Figure 6:
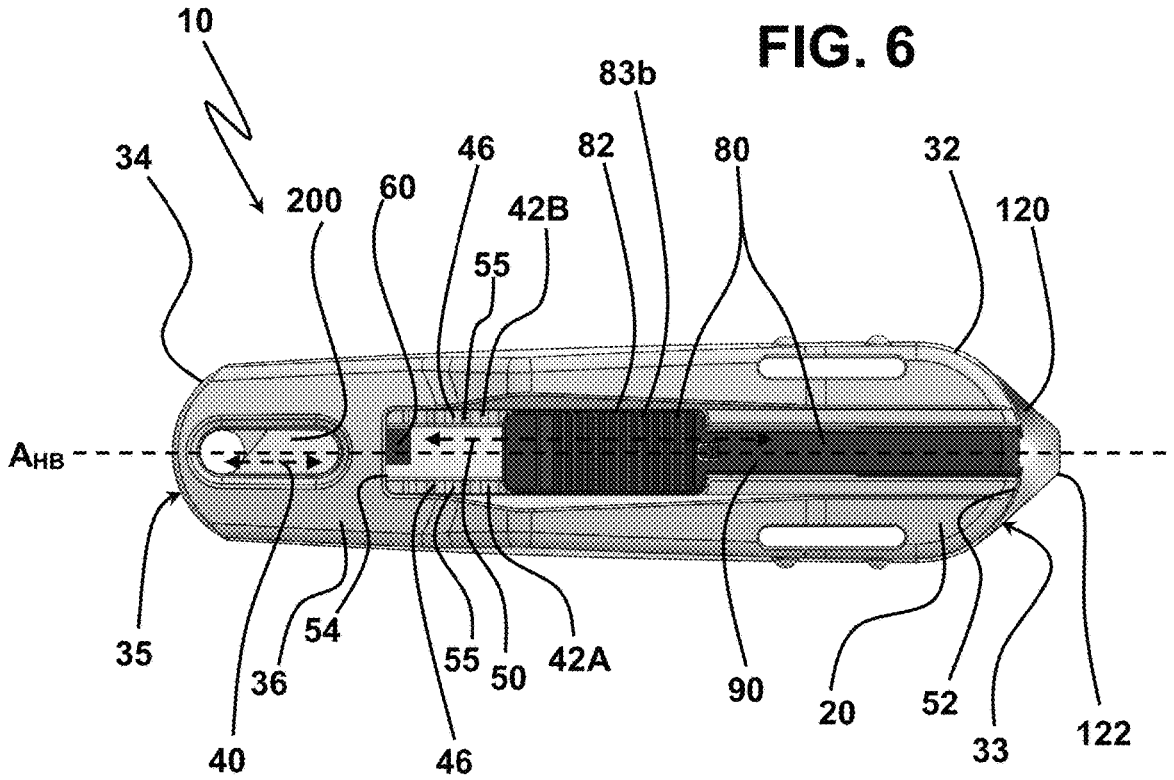
FIG. 6 is a side view of a "side-button" configuration of self-retracting knife including a handle body housing a blade slide and a blade in a retracted position.
Figure 7:
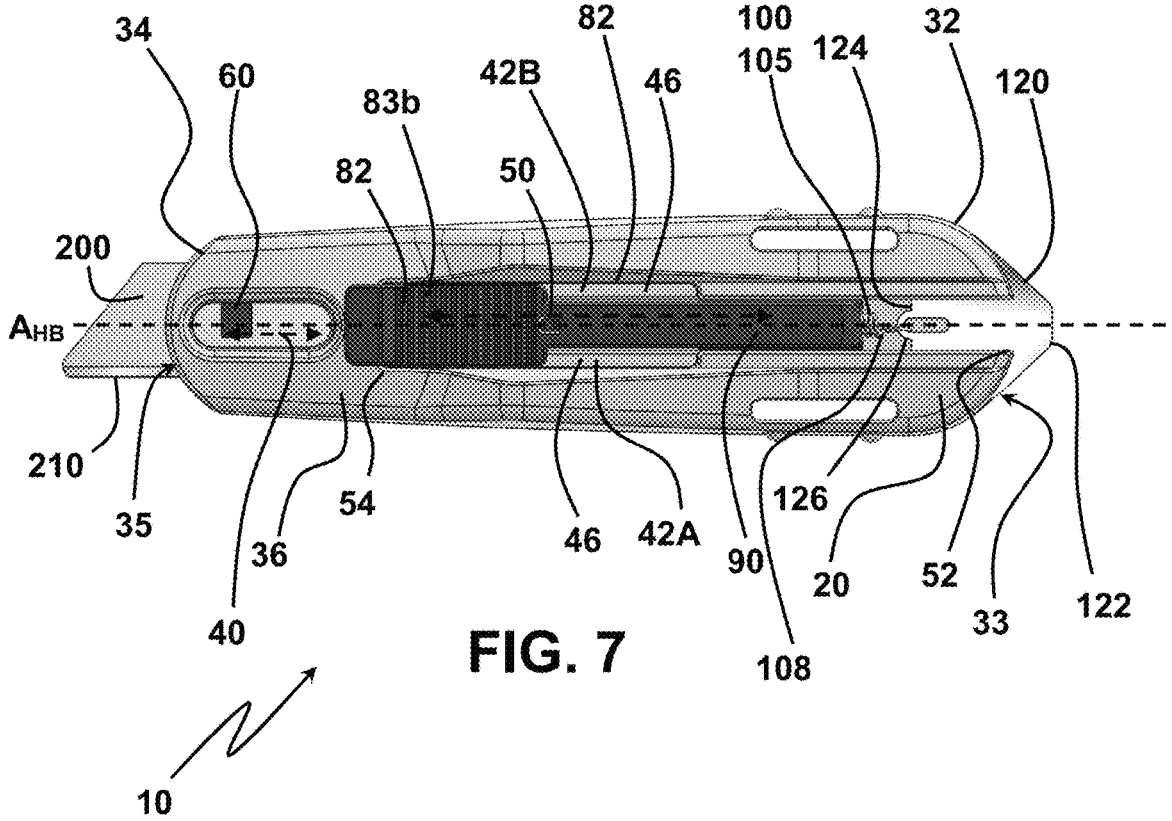
FIG. 7 is a side view of the self-retracting knife of FIG. 6 with the blade slide and blade in a blade-protruding position.

FIGS. 6 and 7 depict a fully assembled side-button version of an illustrative self-retracting knife 10 configured for use with a removable cutting blade 200 in, respectively, blade-storage and blade-protruding positions. Unlike the illustrative top-button configuration shown in FIGS. 1-5B, the side-button version of FIGS. 6-9 does not include separable, and separately identifiable, outer grip and inner blade-guide portions 23 and 24.

As with the top-button version, the side-button version includes a handle body 20 the self-retracting knife 10 has a handle body 20 and a blade slide 60 that is housed within the handle body 20 for linear reciprocation relative to thereto. The handle body 20 comprises at least one handle-body wall 22 and extends longitudinally along a handle-body axis $A_{HB}$ between a handle rear end 32 and a handle forward end 34 including a forward-end opening 35. Additionally, the handle body 20 includes a handle-body outer surface 36 and a handle-body inner surface 38 defining an internal blade-slide cavity 40 that extends rearwardly from the forward-end opening 35 toward the handle rear end 32 and is configured to selectively receive and house a cutting blade 200 that is carried for linear reciprocation by the blade slide 60.

Defined through the handle-body wall 22 is an elongated actuator slot 50. The actuator slot 50 extends longitudinally between a slot first end 52 and a slot second end 54 that is more proximate the forward-end opening 35 than is the slot first end 52. The actuator slot 50 of the side-button version serves the same general function served by the actuator slot 50 of the top-button version.

Unlike the perspective view of the outer grip portion 23 of the top-button version shown in FIG. 5, in the side view of the side-button version shown in FIG. 6, both of first and second guide rails 42A and 42B are visible. The first and second guide rails 42A and 42B extend longitudinally along the handle-body axis $A_{HB}$ and serve to define, at least in part, the actuator slot 50. Moreover, as in the top-button version, a rail top surface 46 of each of the first and second guide rails 42A and 42B defines a handle-body undulated surface 55.

Figure 8:
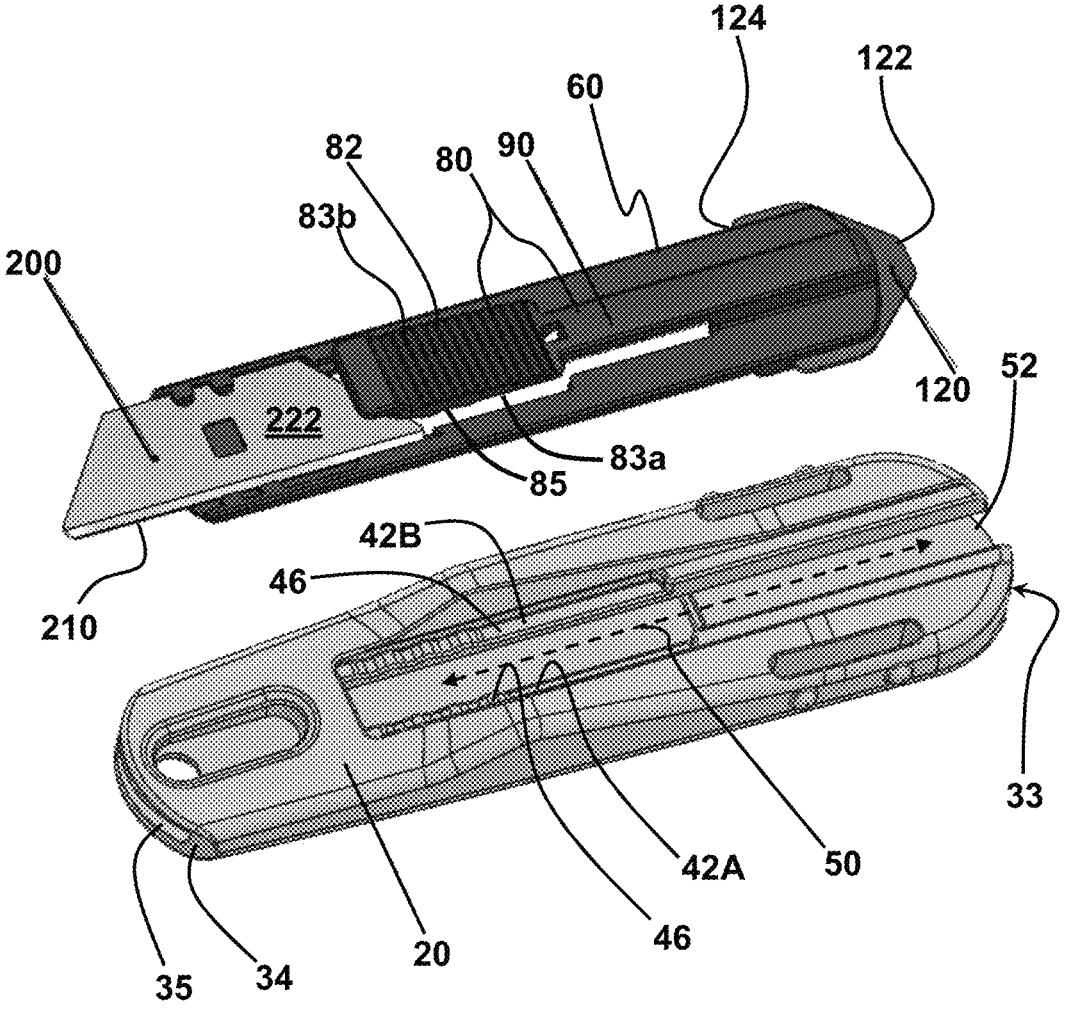
FIG. 8 is a partially exploded view of the self-retracing knife of FIGS. 6 and 7 in which the handle body is separated from the blade slide and blade.
Figure 9:
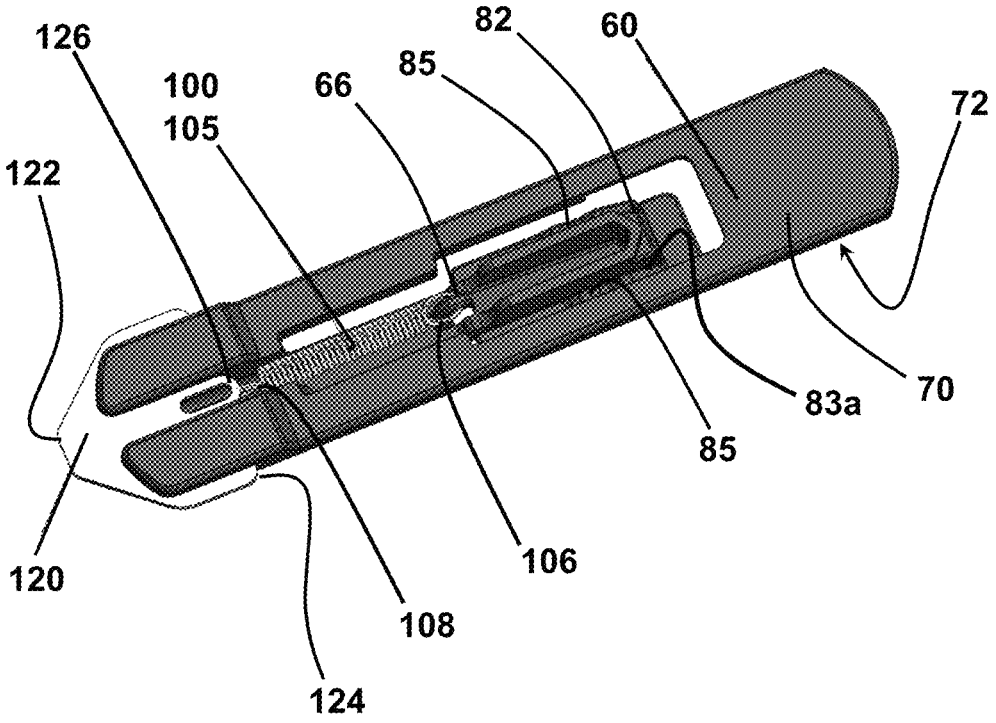
FIG. 9 shows the blade slide of the self-retracting knife of FIGS. 6-8 in isolation.

As seen best in FIGS. 8 and 9 in which the blade slide 60 is shown separately from the handle body 20, a thumb button 82 has a button inner surface 83*a* has defined there-along a button undulated surface 85. In analogous fashion to the operation of the top-button version, when the blade slide 60 is retained within the handle body 20, the button undulated surface 85 is generally aligned for selective interfering engagement with each handle-body undulated surface 55. As the thumb button 82 is displaced forwardly away from the slot first end 52 toward the slot second end 54, the button undulated surface 85 begins to "ride" over the handle-body undulated surface 55. The selective interference fit between button undulated and handle-body undulated surfaces 85 and 55 defines a plurality of blade-protruding positions, as in the top-button version.

The foregoing is considered to be illustrative of the principles of the invention. Furthermore, since modifications and changes to various aspects and implementations will occur to those skilled in the art without departing from the scope and spirit of the invention, it is to be understood that the foregoing does not limit the invention as expressed in the appended claims to the exact constructions, implementations and versions shown and described.

What is claimed is:

1. A cutting knife for use with a removable cutting blade selectively extendable into a plurality of extended cutting positions, the cutting knife comprising:

a handle body having a handle rear end, a handle forward end including a forward-end opening, an internal blade-slide cavity extending rearwardly from the forward-end opening toward the handle rear end, and an actuator slot defined through the handle body between a slot first end and a slot second end, the second end being more proximate the forward-end opening than is the first end;

a blade slide housed at least partially within the blade-slide cavity and configured for (i) removably retaining a cutting blade and (ii) linear reciprocation within the blade-slide cavity between a rearwardmost blade-storage position and a forwardmost blade-protruding position in which a cutting blade carried by the blade slide maximally protrudes through the forward-end opening; and a blade-slide actuator including a thumb button and a flexible finger through which the thumb button is connected to the blade slide, the thumb button including a button inner surface facing the blade slide to the interior of the blade-slide cavity and a button outer surface opposite the button inner surface that faces the exterior of the handle body and is accessible from the exterior of the handle body through the actuator slot for selective engagement, and linear reciprocation of the blade-slide actuator between the slot first and second ends, by a user's thumb;

wherein (i) the handle body has defined along the actuator slot a handle-body undulated surface; (ii) the button inner surface has defined there-along a button undulated surface aligned and configured for selective interfering engagement with the handle-body undulated surface; (iii) reciprocal displacement of the blade-slide actuator toward, alternatively, the slot first and second ends displaces the blade slide toward, respectively, the rearwardmost blade-storage position and the forwardmost blade-protruding position; and (iv) the handle-body and button undulated surfaces are configured and aligned to define a plurality of at least two blade-protruding positions, each of which blade-protruding positions is temporarily maintained by action of a user's depressing inwardly toward the blade slide the thumb button such that the handle-body and button undulated surfaces are maintained in mutual mechanical interference.

2. The cutting knife of claim 1 wherein the blade slide is normally mechanically biased toward the rearwardmost blade-storage position such that, in the absence of an external force applied to linearly displace the blade slide forward of the rearwardmost blade-storage position, a cutting blade carried by the blade slide is retracted within the blade-slide cavity.

3. The cutting knife of claim 2 wherein the blade slide is normally mechanically biased by a biasing member with a forward end attached to the blade slide and a rearward end anchored to the handle body one of (i) directly and (ii) through an intermediate mechanical element.

4. The cutting knife of claim 3 further comprising an on-board tape splitter including a tape-splitting edge, wherein the handle rear end has defined therein a rear-end slot within with the tape splitter is retained such that the tape-splitting edge protrudes from the handle rear end.

5. The cutting knife of claim 4 wherein the tape splitter further includes a splitter-retaining edge opposite the tape-splitting edge and the rearward end of the biasing member is retained by the splitter-retaining edge such (i) that the tape splitter functions as an intermediate mechanical element through which the rearward end of the biasing member is anchored to the handle body and (ii) by the mutual connection of the blade slide and tape splitter through the biasing member, the blade slide and tape splitter are biased toward one another, with the blade slide being biased rearwardly and the tape splitter being biased forwardly relative to the handle body.

6. A self-retracting knife configured for use with a cutting blade having a cutting edge, the knife comprising:

a handle body extending longitudinally along a handle-body axis and having a handle forward end including a forward-end opening, an internal blade-slide cavity extending rearwardly from the forward-end opening, and an actuator slot defined through the handle body and extending longitudinally between a slot first end and a slot second end, the slot second end being more proximate the forward-end opening than is the slot first end;

a blade slide housed at least partially within the blade-slide cavity, the blade slide carrying the cutting blade and being linearly reciprocable between a blade-storage position in which the cutting edge does not extend beyond the forward-end opening and a blade-protruding position in which the cutting edge protrudes through the forward-end opening, the blade slide being mechanically biased toward the blade-storage position; and a blade-slide actuator including a thumb button connected to the blade slide, the thumb button including a button inner surface facing the blade slide within the blade-slide cavity and a button outer surface that faces, and is accessible from, the exterior of the handle body through the actuator slot for selective engagement by a user and linear reciprocation of the blade-slide actuator between the slot first and second ends;

wherein (i) the handle body has defined there-along a handle-body undulated surface; (ii) the button inner surface has defined there-along a button undulated surface configured for selective interfering engagement with the handle-body undulated surface; (iii) reciprocal displacement of the blade-slide actuator toward the slot first and second ends displaces the blade slide toward, respectively, the blade-storage and blade protruding positions; and (iv) the handle-body and button undulated surfaces are configured and mutually aligned to define a plurality of at least two blade-protruding positions, each of which blade-protruding positions is temporarily maintained by action of a user's depressing inwardly toward the blade slide the thumb button such that the handle-body and button undulated surfaces are maintained in mutual mechanical interference.

7. A knife configured for use with a cutting blade having a cutting edge, the knife comprising:

a handle body having a handle forward end with forward-end opening, an internal blade-slide cavity, and an actuator slot defined through the handle body and communicating with the blade-slide cavity;

a blade slide housed at least partially within the blade-slide cavity and carrying the cutting blade for linear reciprocation between a blade-storage position and a blade-protruding position in which the cutting edge, respectively, (i) is housed with the blade-slide cavity and (ii) protrudes to the exterior of the handle body through the forward-end opening; and a blade-slide actuator including a thumb button connected to the blade slide, the thumb button including button inner and outer surfaces, the button outer surface being accessible from the exterior of the handle body through the actuator slot for linear reciprocation by a user of the blade-slide actuator along the handle body;

wherein (i) the handle body includes a handle-body undulated surface; (ii) the button inner surface includes a button undulated surface configured for selective interfering engagement with the handle-body undulated surface; (iii) reciprocation of the blade-slide actuator within the actuator slot displaces the blade slide alternatively toward the blade-storage and blade-protruding positions; and (iv) the handle-body and button undulated surfaces are configured and mutually aligned to define at least one blade-protruding position, each of which at least one blade-protruding positions is temporarily maintained by depressing the thumb button such that the handle-body and button undulated surfaces are maintained in mutual mechanical interference.

8. The knife of claim 7 wherein the blade slide is normally mechanically biased toward the blade-storage position.

9. The knife of claim 8 wherein the button is normally mechanically biased inwardly toward the blade slide such that, when the button undulated surface is adjacent and longitudinally aligned with the handle-body undulated surface, there is a mechanical bias of the button undulated surface toward the handle-body undulated surface.

10. The knife of claim 7 wherein the button is normally mechanically biased inwardly toward the blade slide such that, when the button undulated surface is adjacent and longitudinally aligned with the handle-body undulated surface, there is a mechanical bias of the button undulated surface toward the handle-body undulated surface.

* * * * *